US005853114A

United States Patent [19]

Giovanoli

[11] Patent Number: 5,853,114

[45] Date of Patent: Dec. 29, 1998

[54] DEVICE FOR VENTILATING A CONTAINER FOR LIQUIDS

[76] Inventor: Carlo Giovanoli, Hauptstrasse, CH-7457 Bivo, Switzerland

[21] Appl. No.: 817,780

[22] PCT Filed: Aug. 22, 1996

[86] PCT No.: PCT/CH96/00291

§ 371 Date: Jun. 30, 1997

§ 102(e) Date: Jun. 30, 1997

[87] PCT Pub. No.: WO97/08068

PCT Pub. Date: Mar. 6, 1997

[30] Foreign Application Priority Data

Aug. 22, 1995 [CH] Switzerland ..... 2391/95-5

[51] Int. Cl.[6] ..... B65D 1/20; B65D 25/38; B65D 47/06; B67D 3/00

[52] U.S. Cl. ..... 222/479; 222/481.5

[58] Field of Search ..... 222/478, 479, 222/481, 481.5, 482, 568

[56] References Cited

U.S. PATENT DOCUMENTS

| | | | |
|---|---|---|---|
| 438,396 | 10/1890 | Bellamy | 222/479 X |
| 736,441 | 8/1903 | Pollock | 222/479 X |
| 1,193,157 | 8/1916 | Anderson | 222/479 X |
| 2,291,230 | 7/1942 | Johnson . | |
| 3,834,594 | 9/1974 | Schiemann | 222/479 X |
| 4,034,901 | 7/1977 | Kirk | 222/481.5 |

FOREIGN PATENT DOCUMENTS

| | | | |
|---|---|---|---|
| 936549 | 11/1946 | France . | |
| 1420554 | 10/1964 | France . | |
| 2157791 | 6/1973 | France . | |
| 2026921 | 12/1971 | Germany | 222/479 |
| 8503289 | 6/1987 | Netherlands | 222/541.9 |
| 537308 | 7/1973 | Switzerland . | |
| 854860 | 11/1960 | United Kingdom | 222/479 |

*Primary Examiner*—Kevin P. Shaver
*Attorney, Agent, or Firm*—Friedrich Kueffner

[57] ABSTRACT

A liquid container (1) which serves to hold liquid and which can be emptied has a ventilation device (5) which can be installed in the filling and emptying opening (4). The ventilation device (5) has line portions (9, 10) of an air line which are angled in the outlet region of the filling and emptying opening (4). One line portion (9) communicates with the surrounding air and the other line portion (10) extends into the container region or hollow space (11) of the liquid container located farther away from the filling and emptying opening (4) and is formed at its end by a shut-off valve (14) which can be acted upon by liquid.

15 Claims, 1 Drawing Sheet

DEVICE FOR VENTILATING A CONTAINER FOR LIQUIDS

BACKGROUND OF THE INVENTION

1. Field of the Invention

The invention is directed to a device for ventilating a container for liquids or liquid container which is formed by a removable ventilation device projecting into the container and having line portions of an air line which are angled in the outlet region of the filling opening or emptying opening.

2. Description of the Related Art

Devices of this type are used, for example, in liquid containers for transporting, storing, and making available operating media of all kinds such as fuels, oils or the like, foodstuffs, additives, etc. In particular, repair and maintenance operations for vehicles, machine tools and machinery, machine shops, construction firms and manufacturing operations in the metalworking industry deal with the handling of such liquids.

The devices mentioned above are used, at the same time, for moderately apportioned distribution of liquid held in a container into other containers, e.g., those having a relatively narrow inlet, such as cans, housings or the like.

Liquid containers which are filled up to the filling and emptying neck prevent a laminar flow of liquid out of a container as long as air from the atmosphere is not allowed to enter the hollow interior of the container. At least at first, i.e., until that time when sufficient air can flow into the container via the filling and emptying neck, the liquid flows out in an uncontrollable manner or a time-consuming emptying process takes place accompanied by loss of liquid and/or cleaning work results in the affected surrounding area subsequently.

In order to counter these circumstances, manufacturers of liquid containers or cans have arranged a ventilating line inside the filling and emptying opening forming a connection between the atmosphere and the container space.

For example, CH-A-537308 discloses a liquid container in which at least one holding strip which is formed out in a protruding manner is provided at the inner side of the filling and emptying neck for receiving the ventilation line by means of a holding slot of complementary design such that the ventilation line can be pushed onto the holding strip.

In contrast to a fixed arrangement of the ventilation line, the ventilation line can be removed to fully expose the filling and emptying neck so as to improve access to the container space.

Nevertheless, with the ventilation line disclosed in the cited reference, which has an angled shape in the outlet region of the container, turbulence or unevenness in the liquid flowing out at the filling and emptying opening can also be prevented only after a quantity of liquid has been removed from the full container, because the short ventilation line does not allow any air into the container as long as the end projecting into the container space is located below the surface of the liquid. Also, when containers are partly empty, the air contained therein is not sufficient to prevent uneven emptying.

SUMMARY OF THE INVENTION

Accordingly, the object of the present invention is to provide a device of the type mentioned above which enables a liquid container or can in the filled state to be ventilated as it is being emptied so that a measured, laminar flowing out of liquid can take place.

This object is met in accordance with the invention in that the line portion of the ventilation device adjoining the line portion communicating with the surroundings extends in a region of the container located farther away from the filling and emptying opening under the upper wall of the container. As a result of this technical step, it is possible when emptying the container for air in the surrounding atmosphere to enter this container, especially in the small hollow space first formed in the upper container region by the initial tilting of the liquid container, and for air to flow in from the surroundings.

The vacuum created in the container when the liquid flows out can be compensated by the suction effect occurring in the surroundings via the line portions by the supply of air to the container region or hollow space of the liquid container.

For this purpose, the container region can be formed by side walls or, in the case of cylindrical containers, by the outer surface of the container and the upper container wall.

It has proven advisable that the container region be formed by means of a bead-like raised portion so that an effect which promotes the supply of air to the container region or hollow space which enlarges visibly as the liquid flows out is created in the liquid container from the outset when emptying.

In a particularly advantageous manner, the end of the line portion projecting into the container region is formed by a shut-off valve which can be acted upon by liquid, so that liquid can be prevented from entering the line portions.

The shut-off valve is preferably formed by a floating body which faces the liquid and is constructed as a shut-off member and is moved against a valve seat by the liquid when the container is full.

In the interest of simplicity, the shut-off member is spherical or conical and has a smaller specific weight than the liquid, resulting in buoyancy; a spherical shut-off member requires no special guide in view of its regular shape.

The shut-off member can be arranged in a preferably cage-like housing so as to be movable from a valve opening position into a closing position against the valve seat. On the one hand, the cage-like housing has an inlet opening for the liquid acting on the shut-off member; on the other hand, the cage-like housing is connected with the line portion of the ventilation device projecting into the container or with the surroundings.

The connection of the housing with the line portion is provided behind the valve seat by means of a line throat. The functioning of the shut-off valve is ensured by clear design ratios.

It has proven suitable that the line portions are widened at their point of connection so that any possible small amount of liquid entering via the shut-off valve can flow off more easily via the ventilation device.

In case it is necessary for liquid to flow out via the ventilation device, the line portion adjoining the shut-off valve has an inclined position acting toward the connection point.

In this respect, the housing is advantageously arranged in such a way that the movement direction of the shut-off member toward the valve seat and the line portion at least directly adjoining the latter form an acute angle $\alpha$.

The line portion communicating with the surroundings is advantageously connected with the inner wall of a pour spout which is constructed is an emptying neck and designed such that it can be inserted and fixed in the filling and emptying opening of the container from the outside resulting in an all-purpose ventilation device.

In order to allow the air to be guided without hindrance into the container region or hollow space while emptying the liquid from the container via the emptying neck or pour spout, the line portion facing the surroundings is constructed so as to be closed at the end within the emptying neck, but has openings in the region separate from the emptying neck or pour spout which pass outward and communicate with the surroundings.

The absolute separation of liquid and air supply in the emptying region or in the emptying neck or pour spout serves another purpose; namely, when the surface of the liquid is turbulent due to use or transporting of a container, no liquid can penetrate into the ventilation device, which, in larger amounts, could impair the airway of the latter. At the same time, this means that the ventilation device can remain in the filling and emptying opening at any time without restrictions and can be removed when filling the container, although this is not compulsory. This is in contrast to known containers which have emptying necks that can be tightly clamped or screwed on the emptying opening.

A dividing wall which is arranged in segments along the length of the line portion in the pour spout is particularly well-suited for this purpose, this dividing wall being tightly connected with the inner wall of the pour spout at its side edges, wherein the air passage openings at the pour spout are provided in the region of the dividing wall. The dividing wall even of the line portion which is closed at the end could also be replaced by a tube which is fastened tightly to the inner wall of the pour spout and has a connection opening communicating with the through-opening of the pour spout.

The pour spout or emptying neck is bent in the tilting direction of the container to be emptied so that a positive influence can be exerted on the flow-out direction beforehand.

A closing cap which can be pushed in or snapped onto the emptying neck or pour spout preferably serves to prevent the escape of gases or fumes from the container and to prevent contamination of the contents of the container and ventilation device which also affects the airway openings.

The fastening of the ventilation device to the filling and emptying opening is preferably effected in that the pour spout can be firmly screwed onto the filling and emptying opening by means of an annular union nut so as to be supported. A screw connection, known per se, has proven suitable for this purpose and can form a tight connection.

The line portion communicating with the surrounding air ends before the outlet opening of the pour spout so as not to interfere with the flow of liquid from the pour spout.

The container according to the invention will be explained more fully in the following with reference to an embodiment example shown in the drawing which is referred to expressly as concerns any particulars not mentioned more fully in the description.

DESCRIPTION OF THE PREFERRED EMBODIMENTS

Figure 1:
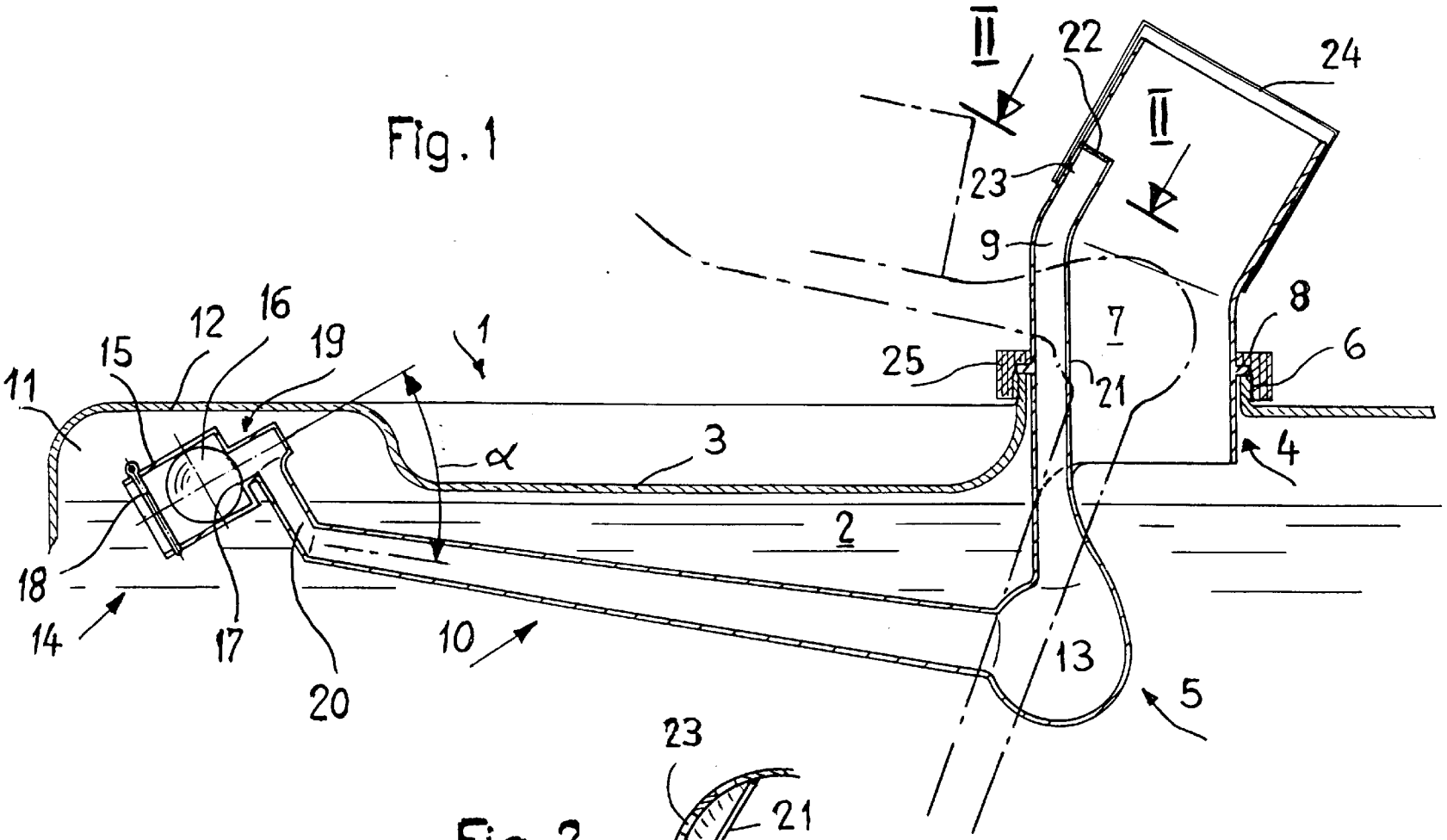
FIG. 1 shows a longitudinal section through a container provided with a ventilation device according to the invention.
Figure 2:
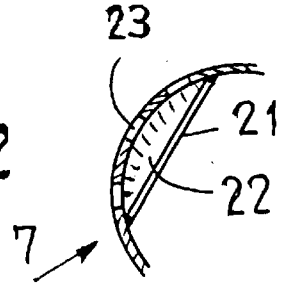
FIG. 2 shows a cross section along line II—II in FIG. 1.

FIG. 1 shows the upper region of a container 1 provided for receiving a liquid 2. The surface of the liquid is located in the vicinity of the upper container wall 3. A stirrup-shaped handle by which the container 1 is carried or by means of which it is emptied is not shown. Such handles are known and need not be described further.

The container 1 further has a filling and emptying opening 4 which is arranged in the upper container wall 3 in the vicinity of a side end. In order to be able to close the container 1, the filling and emptying opening 4 has an external thread 6 on which a screw closure, not shown, can be screwed.

In the position shown in the drawing, the container 1 is ready to be emptied and a ventilation device is installed in the filling and emptying opening 4, this ventilation device being tightened on the external thread 6 on the filling and emptying opening 4 by means of an annular union nut 25. For this purpose, an annular shoulder 8 is arranged on a pour spout 7 of the ventilation device 5 so as to contact the edge of the filling or emptying opening 4.

Shown in the outlet region of the filling and emptying opening 4 are connected line portions 9, 10 of the ventilation device 5 through which surrounding air is guided into the container region 11 or into a hollow space of the liquid container 1, wherein line portion 9 communicates with the surrounding atmosphere and line portion 10 projects into the container region or hollow space 11. The latter line portion 10 is situated farther from the filling and emptying opening 4 and is formed by the upper container wall 3 and by three side walls of the container 1. In the present embodiment example, the container region or hollow space 11 has a bead-like raised portion 12.

The line portion 10 extending in this container region or hollow space 11 is connected at an angle with the line portion 9 facing the surroundings and communicating therewith. At least line portion 10 has a widened line cross section which widens increasingly toward the connection point 13 forming a collecting space for unwanted liquid from the container 1.

The end of the line portion 10 extending toward the container region or hollow space 11 is constructed with a shut-off valve 14 which can be actuated by the liquid 2. This shut-off valve 14 is formed by a shut-off member 16 which is arranged in a housing 15 so as to be movably guided. The shut-off member 16 is spherical and has a lower specific weight than the liquid 2 which, in turn, presses the shut-off member 16, which is designed as a floating body, against a valve seat 17 of the housing 15 and accordingly blocks the access of liquid to the ventilation device 5.

On the other hand, as the liquid level drops in the enlarging container region or hollow space 11, air from the surroundings can flow into the container region or hollow space 11 via the ventilation device 5 owing to a vacuum developing in the container region 11 as a result of emptying when the shut-off member 16 is lifted from the valve seat 17 and this air can provide for a calm flow of liquid out of the pour spout 7. The shut-off member 16 which is made from wood or plastic, for example, and is also hollow and acts by means of buoyancy now contacts a safety device 18 in the housing 15 and has opened the ventilation device 5.

The container 1 can now be emptied from the pour spout 7 without turbulence and unevenness.

A line throat which is closed at the end adjoins the rear of the valve seat 17, an end piece 20 of line portion 10 opening laterally into this line throat. The end piece 20 permits the shut-off valve 14 to be positioned very close to the upper container wall 3 so that when the container 1 is filled the effect expected from the ventilation device 5 occurs immediately when emptying.

Any liquid which may penetrate into the ventilation device 5 in the course of its installation or use is first collected in the connection point 13, for which purpose the line portion 10 must be inclined.

The movement direction of the shut-off member 16 and the direction of extension of the line portion 10 enclose an acute angle $\alpha$ so that the ventilation device 5 can be substantially fully functional when the container is filled. The angle $\alpha$ is governed by the geometry and particular relative arrangement of the line portions 9, 10 which is roughly 45°.

The housing 15 in which the shut-off member 16 is located is to be arranged with respect to line portion 10 at an acute angle such that the shut-off member 16 is pressed or displaced against the valve seat 17 when contacted or when submerging in the liquid.

Line portion 9 is formed by the inner wall of the pour spout 7 and by a dividing wall 21 penetrating it in segments in cross section. This line portion 10 ends below the pour spout 7 in a roughly circular cross section which is suitable as a transition for forming the expanded connection point 13.

The line portion 9 which ends before the outlet opening of the pour spout 7 is provided with a closing plate 22 or ends with the terminating dividing wall 21 at the inner wall of the pour spout 7 so that there is no connection between the line portion 9 and the pour spout 7.

The air is supplied to the container region or hollow space 11 via airway openings 23 which open into line portion 9.

The pour spout 7 is bent in its projecting region and is constructed in such a way that a closing cap 24 can be attached to it.

In FIG. 1 a dash-dot line indicates the position of the ventilation device 5 in which it is installed in or removed from the filling and emptying opening 4 of the container 1. In the case of installation, the shut-off member 16 having a smaller specific weight is pressed against the valve seat 17 due to buoyancy when the shut-off valve 14 is immersed in the liquid 2, so that the ventilation device 5 is free of liquid and, even as first liquid is removed, the air entering the line portions 9, 10 can flow into the container region or hollow space 11 which is formed and constantly becomes larger due to the tilting of the container 1 or can flow from the surroundings via the airway openings 23.

I claim:

1. A device for ventilating a liquid container having an upper wall and a filling and emptying opening with an outlet region, comprising a removable ventilation device projecting into the container, the removable ventilation device comprising a first line portion in communication with surroundings and a second line portion adjoining the first line portion, wherein the first and second line portions extend at an angle relative to each other in the outlet region of the filling and emptying opening, and wherein the second line portion extends into a container region located farther away from the filling and emptying opening and located underneath the upper wall of the containers further comprising a liquid-operated shut-off valve mounted at an end of the second line portion projecting into the container region.

2. The device according to claim 1, comprising a widened collecting space between the first line portion and the second line portion.

3. The device according to claim 2, wherein the second line portion is arranged so as to be inclined toward the collecting space.

4. The device according to claim 1, wherein the shut-off valve comprises a shut-off member configured as a floating body.

5. The device according to claim 4, wherein the shut-off member is spherical.

6. The device according to claim 4, comprising a cage-like housing at the end of the second line portion, the shut-off member being located in the cage-like housing so as to be movably guided between a position allowing access from the container to the second line portion and a valve seat attached to the end of the second line portion.

7. The device according to claim 6, further comprising a line throat connected to the valve seat of the housing.

8. The device according to claim 6, wherein a movement direction of the shut-off member in the cage-like housing and a direction of longitudinal extension of the second line portion form an acute angle, whereby the shut-off member is pressed against the valve seat by the liquid when the shut-off member is contacted by or is submerged in the liquid.

9. The device according to claim 1, further comprising a pour spout exchangebly mounted in the filling and emptying opening, the pour spout having an inner wall, the first line portion being connected to the inner wall of the pour spout.

10. The device according to claim 9, wherein the pour spout is bent in an emptying direction of the container.

11. The device according to claim 9, further comprising an annular union nut for effecting a screw connection between the pour spout and the filling and emptying opening.

12. The device according to claim 9, wherein the pour spout has an outlet opening and wherein the line portion facing the surroundings ends in front of the outlet opening of the pour spout.

13. The device according to claim 9, wherein the first line portion is constructed so as to be not in communication with the pour spout, and wherein the first line portion has at least one air passage opening in communication with the surroundings and which extends through the pour spout.

14. The device according to claim 13, comprising a dividing wall between the first line portion and the pour spout.

15. The device according to claim 13, further comprising a closing cap removably mounted on the pour spout for closing the filling and emptying opening and the air passage opening in a dust-tight manner.

* * * * *